US007841208B2

(12) United States Patent
Lefor

(10) Patent No.: US 7,841,208 B2
(45) Date of Patent: Nov. 30, 2010

(54) METHOD AND SYSTEM FOR IMPROVING THE EFFICIENCY OF A REFRIGERATION SYSTEM

(75) Inventor: Randy Lefor, Phoenix, AZ (US)

(73) Assignee: Refrigerant Technologies, Inc. Arizona Corporation, Phoenix, AZ (US)

( * ) Notice: Subject to any disclaimer, the term of this patent is extended or adjusted under 35 U.S.C. 154(b) by 315 days.

(21) Appl. No.: 11/891,583

(22) Filed: Aug. 9, 2007

(65) Prior Publication Data

US 2009/0038321 A1 Feb. 12, 2009

(51) Int. Cl.
*F25B 41/06* (2006.01)

(52) U.S. Cl. ..... 62/527; 62/222; 62/223; 62/224; 62/225; 165/207; 165/274; 165/302

(58) Field of Classification Search ..... 62/222–225, 62/527; 165/207, 274, 302
See application file for complete search history.

(56) References Cited

U.S. PATENT DOCUMENTS 2,159,251 A * 5/1939 Brizzolara ..... 62/117
2,724,246 A * 11/1955 Lowe ..... 62/119
5,341,656 A * 8/1994 Rust et al. ..... 62/324.6
5,842,351 A * 12/1998 Earhart, Jr. ..... 62/117
6,185,944 B1 2/2001 Gaul
6,389,825 B1 5/2002 Wightman
6,401,470 B1 6/2002 Wightman
6,401,471 B1 6/2002 Wightman
6,672,091 B1 1/2004 Lefor
6,857,281 B2 2/2005 Wightman
7,086,249 B2 8/2006 Younglib
7,157,407 B2 1/2007 Shinichiro

OTHER PUBLICATIONS

Effects of Non-Uniform Refrigerant and Air Flow Distributions on Finned-Tube Evaporator Performance; © 2003 http://fire.nist.gov/bfrlpubs/build03/PDF/b03081.pdf, last accessed on Mar. 19, 2010 Website published Oct. 12, 2006.*

* cited by examiner

*Primary Examiner*—Cheryl J Tyler
*Assistant Examiner*—Justin Loffredo
(74) *Attorney, Agent, or Firm*—Gregory J. Nelson

(57) ABSTRACT

A compression refrigeration system and evaporator having multiple circuits. Spray nozzles are provided for atomization and expansion of the refrigerant. The atomizing spray nozzles are interposed in each evaporator circuit and the nozzles are sized to distribute atomized refrigerant to the various evaporator circuits based on airflow rates across the associated circuit.

8 Claims, 12 Drawing Sheets

METHOD AND SYSTEM FOR IMPROVING THE EFFICIENCY OF A REFRIGERATION SYSTEM

FIELD OF THE INVENTION

The present invention relates to a method and system for a refrigeration system and more particularly relates to a system for efficiently atomizing and distributing the atomized refrigerant to the evaporator of a refrigeration system. The invention also relates to a method for balancing the refrigerant flow in a multiple circuit evaporator to optimize the heat transfer capability to achieve greater cooling.

BACKGROUND OF THE INVENTION

A typical vapor compression refrigeration system includes a compressor, a condenser, an evaporator and expansion device arranged to transfer heat energy between a refrigerant in heat transfer relationship with air in the evaporator and in the condenser.

The evaporator removes or extracts unwanted heat, cooling air which is forced across the evaporation coils. The purpose of the condenser is to extract heat from the refrigerant transferring heat to the outside air. Within the refrigeration system, the expansion device is located in the refrigerant line ahead of the evaporator. High pressure liquid reaches the expansion device and the pressure of the refrigerant is reduced as it passes through the expansion device. In many systems, the evaporator has a plurality of circuits or conduits which carry the refrigerant and a fan or blower forces air across the multiple circuits in heat exchange relationship to cool the air. Various heat exchanger designs are available such as flat plate, fin and tube and others which are intended to increase the heat exchange efficiency between the refrigerant and the airflow.

Refrigeration systems of the type are widely used in various applications such as ice machines, automotive air conditioners, residential and commercial air conditioners, appliances and refrigeration systems for walk-in coolers. Some systems of this type may be reversible or designed at heat pump systems, often used for residential heating and cooling.

Various types of expansion devices can be found in the prior art. My prior patent, U.S. Pat. No. 6,672,091 discloses an expansion device for a refrigeration system having a piston which reciprocates to either open or close ports to increase or decrease the volume of atomizer refrigerant liquid received from the condenser. Atomization may be enhanced by using an auxiliary, ultrasonic electrostatic devices.

BRIEF SUMMARY OF THE INVENTION

The present invention provides an atomization system for use in a refrigeration system which is installed between the condenser and evaporator to atomize and distribute the atomized vapor to the evaporator to achieve better performance and efficiency.

In one embodiment, the atomization system of the present invention includes an atomizing spray nozzle which is connected to receive high pressure liquid from the condenser. The spray nozzle atomizes the refrigerant and discharges it into a distributor. The distributor is connected via a plurality of conduits to the various circuits within the evaporator with atomized refrigerant is being delivered to each of the circuits. The system may include a filter, strainer and a flow-control valve disposed between the spray nozzle and the condenser. The distributor is designed to deliver a volume of refrigerant to each circuit based on the airflow passing across the circuit to achieve more efficient cooling.

In another embodiment, an atomizing spray nozzle is interposed in each evaporator circuit which receives a liquid refrigerant from a header. Each nozzle discharges directly into the associated circuit in the evaporator. The system may also include a strainer, filter and a flow-control valve associated with each atomization unit. The nozzle sizes are selected to distribute atomized refrigerant to the various circuits based on the airflow rate passing across the associated circuit.

In yet another embodiment of the present invention, a bypass valve is provided which directs liquid refrigerant to one or more auxiliary spray nozzles adjacent one or more spray nozzles receiving liquid refrigerant from the condenser. The auxiliary spray nozzle may be used to provide additional atomization capacity during heavy loads or start-up. The spray nozzles discharge into a distributor which is connected by conduits to the various circuits in the evaporator.

In another embodiment, the present invention relates to a method of improving the efficiency of existing refrigeration systems by replacing existing expansion devices such as capillary tubes or thermostatic expansion valves (T×V) with atomization nozzles and sizing of the nozzles in the individual evaporator circuits in relation to the airflow across each individual circuit. A booster pump to increase the pressure of the refrigerant supply to the atomization nozzles may also be provided.

BRIEF DESCRIPTION OF THE DRAWINGS

The above and other advantages and objects of the present invention will become more apparent from the following description, claims and drawings in which:

DETAILED DESCRIPTION OF THE DRAWINGS

Figure 1:
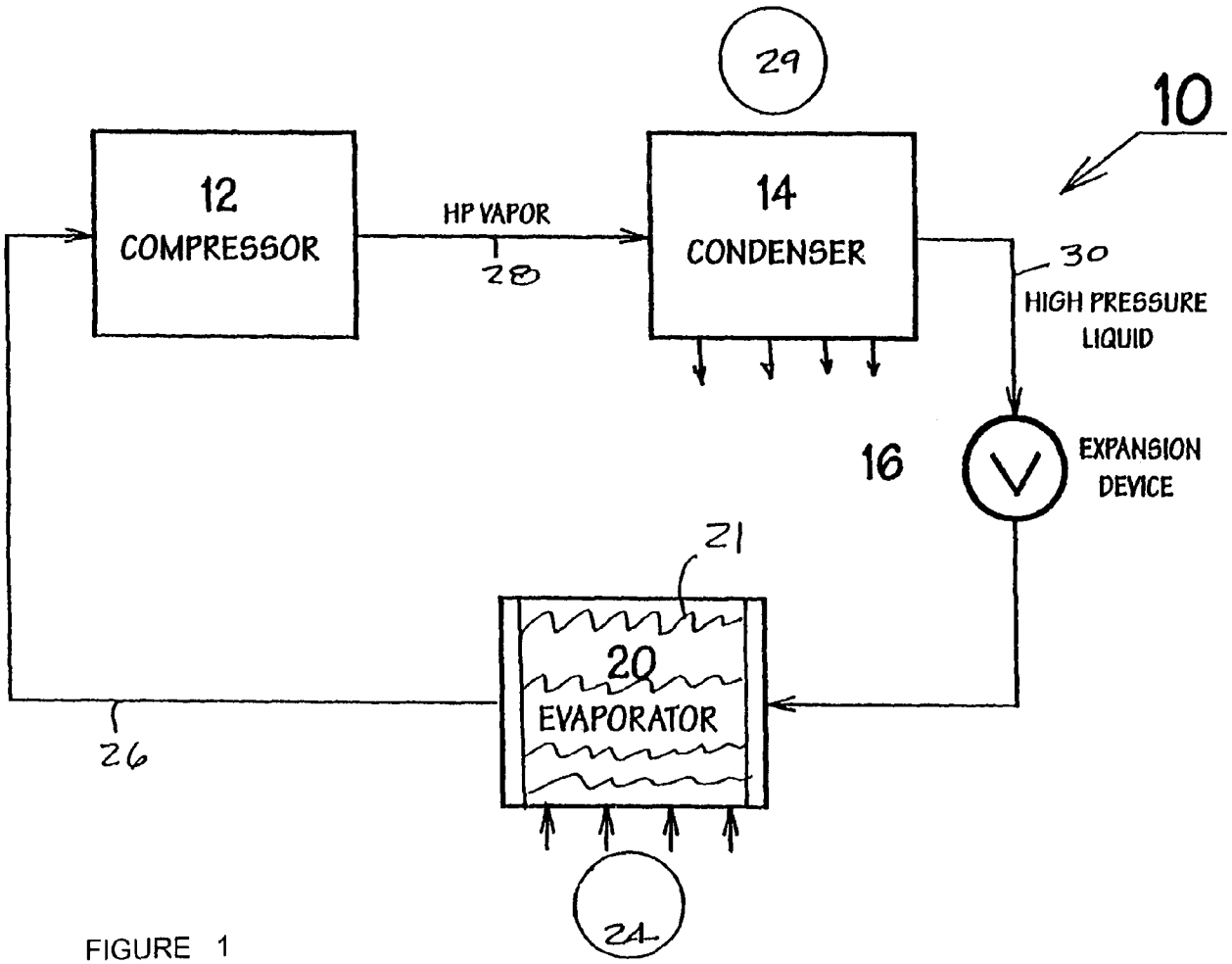
FIGURE 1 (PRIOR ART)
FIG. 1 is a schematic diagram showing a representative refrigeration circuit with the atomization device of the present invention installed therein.

The atomization system of the present invention will typically be installed in a refrigeration system of the type shown in FIG. 1. The typical refrigeration circuit uses a compressible refrigerant. Typical refrigerants are R22 and the newer refrigerants such as R134 and Puron® and blends which are more environmentally acceptable. The refrigeration effect is achieved by evaporating a liquid having a relatively low boiling temperature in an evaporator.

The representative refrigeration system shown in FIG. 1 consists of a compressor 12 in which the refrigerant is vaporized and is raised in pressure usually accompanied by cooling. A condenser 14 receives the high pressure vapor in which heat is removed from the compressed refrigerant causing it to condense into a high pressure liquid. The conventional system includes an expansion device 16 between the condenser and evaporator in which a joule-thomson expansion occurs and which results in the evaporation of some of the liquid and cooling of both the liquid and vapor to the temperature of the evaporator in which the remaining liquid is converted to vapor by absorption of heat from airflow. The cooled air is then introduced into a space to be cooled.

The evaporator may contain a single circuit or, as is typical with larger units, a plurality of individual circuits 21 having fins, tubes, plates or other configurations for improved heat transfer capability are contained within the evaporator. The refrigerant is distributed and passes through the various multiple circuits. The medium to be cooled such as air is passed across the evaporator circuits by a fan or blower 24 extracting heat from the medium to be cooled. However, tests have indicated that, due to evaporator designs and the positioning of the fan or blower in the evaporator, airflow rates vary considerably across the individual circuits and, as a result, the greatest cooling often occurs only through several of a multiple coil unit and the remaining circuits operate at less than optimum efficiency.

The compressor draws low temperature, low pressure vapor from the evaporator via the suction line 26. The vapor is compressed in the compressor and rises in temperature transforming the vapor from a low temperature vapor to a high temperature vapor, increasing the pressure. The vapor is then discharged from the compressor and the discharge line 28 contains high pressure vapor which is introduced into the condenser 14.

Figure 11:
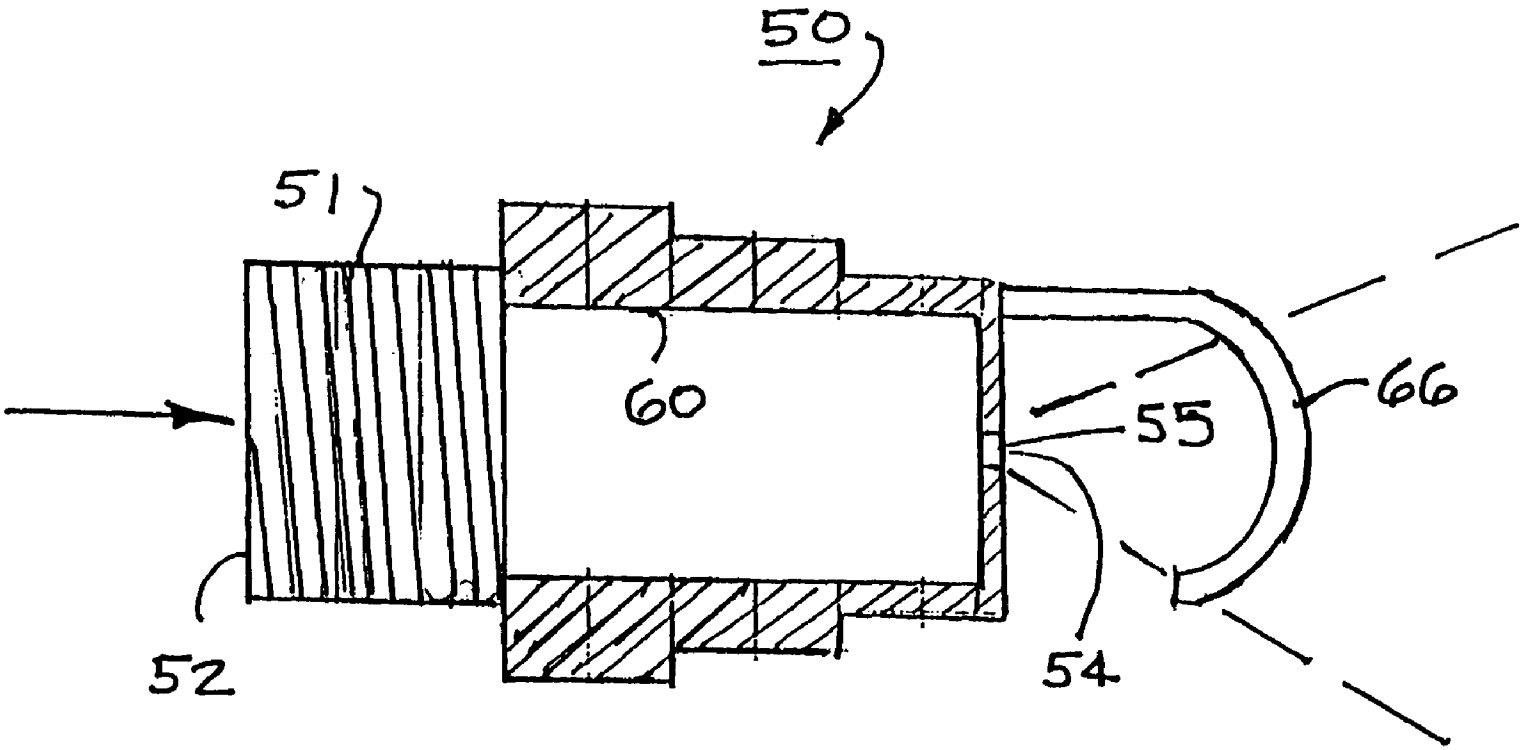
FIG. 11 is a perspective view, partly broken away, of a representative nozzle which atomizes the refrigerant replacing a conventional thermostatic expansion valve or other expansion device.

The condenser 14 has one or more circuits which extract heat from the refrigerant transferring it to outside air. The condenser in residential and commercial cooling systems is often installed on the roof or exterior of a building. A fan or blower 29 is used to draw air across the condenser. The temperature of the high pressure vapor determines the temperature at which condensation occurs. As heat is rejected from the condenser and transferred to the air, the condensation temperature must be higher than the air. The high pressure vapor within the condenser is then cooled and becomes a liquid which flows from the condenser to the liquid discharge line. In most conventional refrigeration systems, expansion of the refrigerant occurs in an expansion device which is typically a valve having an orifice. As mentioned above, my prior patent, U.S. Pat. No. 6,672,091 discloses an atomization device for a refrigeration system which is a valve having a plurality of orifices or nozzles at spaced-apart locations which can be selectively controlled by a piston. In the present invention, vaporization of the refrigerant occurs in one or more spray nozzles 50, as shown in FIG. 11, having an inlet 52 connected to the high pressure liquid supply from the condenser and an outlet.

Preferably the nozzle outlet 54 disperses a spray in a general cone-shaped pattern of saturated liquid having a high percentage of droplets in the 10 to 400 micron range. The nozzle outlet has an orifice 55 the size of which may vary with the particular application depending on refrigerant flow rates and pressure. Nozzles of this type are available from several manufacturers such as Bex and Bete. Common materials are brass or stainless steel.

The body of nozzle 50 is provided with threads 51 at the inlet for connection in a refrigeration system. A bore 60 extends through the body terminating at an outlet at a small orifice 55. The orifice creates a cone-shaped, fine atomized spray pattern of saturated liquid. A U-shaped pin 66 may be secured to the body aligned with the outlet orifice 55 and spaced from the orifice. The pressurized vapor is discharged in a conical pattern and a portion will impinge on the pin further generating fine, atomized droplets.

The size and capacity of the nozzle 50 will vary depending on the size of the refrigeration system. For example, the compressor of a refrigeration system discharges about 0.5 GPM of refrigerant per ton of refrigeration capacity. The total refrigerant flow (GPM) may be approximated by the number of tons×0.5. A single nozzle would be sized to accommodate the total flow rate. If multiple nozzles are used, then the formula GPM/Number of Nozzles would apply in calculating the size of the individual nozzles in an evaporator having uniform airflow across each circuit. The outlet orifice is sized for fine dispersion, usually having a diameter of between 0.020" to 0.150." However, as is discussed below, if the airflow across the evaporator circuits is non-uniform, the nozzle flow rates of the various multiple nozzles may be further adjusted and varied for actual airflow rates to achieve better performance.

Figure 2:
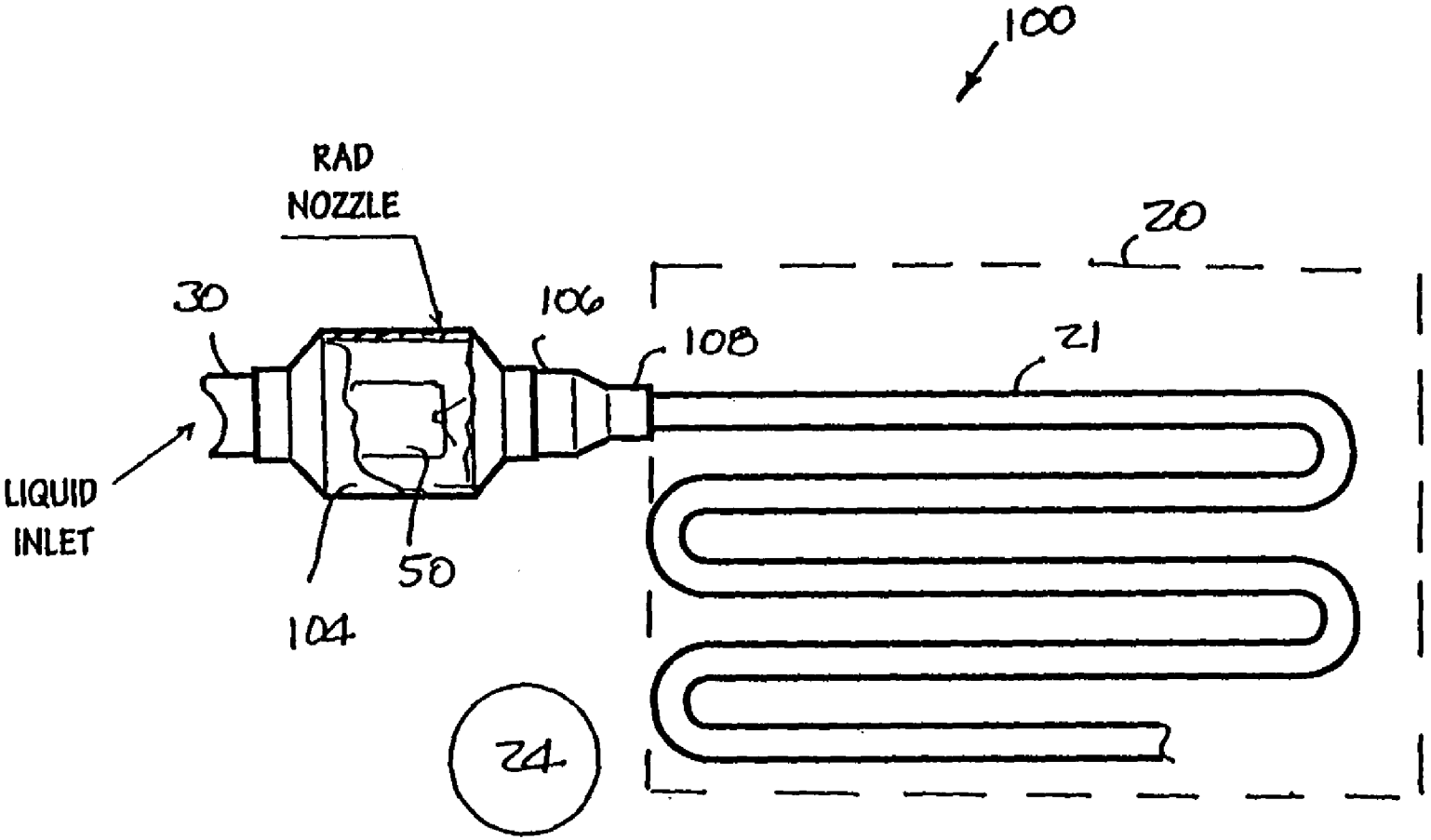
FIG. 2 is a diagram of a portion of a refrigeration system showing the atomization device of the present invention connected to a single evaporator circuit.

FIG. 2 illustrates a section of a refrigeration circuit 100 incorporating an atomization device according to the present invention. The section 100 of the circuit shown is a section interposed between the condenser and the evaporator 20. Note that the same or similar numerals are used throughout the specification to designate the same or similar elements. A cylindrical housing 104 contains one or more atomization nozzles 50 of the type described above. The inlet 52 to each nozzle 50 is connected to a high pressure liquid line 30 from the condenser. The atomized fine liquid spray emitted from the nozzles is discharged into the housing 104 and through the reduced diametral sections of reducers 106 and 108. Reducer 108 is connected to the evaporator which consists of a circuit 21 through which the atomized vapor flows in heat exchange relationship with air which is blown across the evaporator coil. Circuit 21 typically includes a plurality of serpentine sections, as shown, and may be provided with fins for increased heat exchange capacity and efficiency. Accordingly, the nozzle 50 atomizes the liquid from the condenser to the fully supersaturated state. Air is passed across the circuit 21 by a blower or fan 24. The incorporation of the atomization nozzle 50 eliminates and replaces the conventional expansion device such as device 16 of FIG. 1.

The advantages of delivering the refrigerant to the evaporator in the form of a saturated liquid are substantial. These advantages include, but are not limited to, the following:

1. Atomization reduces the presence of liquid which lessens wear on the piston, valves and compressor components.
2. A cooler suction vapor is provided to the motor windings.
3. Lower discharge gas temperatures with greater temperature exchange of air across the evaporator is achieved.
4. The presence of saturated liquid in the evaporator provides a wetter coil which, in turn, provides greater heat transfer.
5. Greater cooling output per pound of refrigerant occurs.

Figure 3:
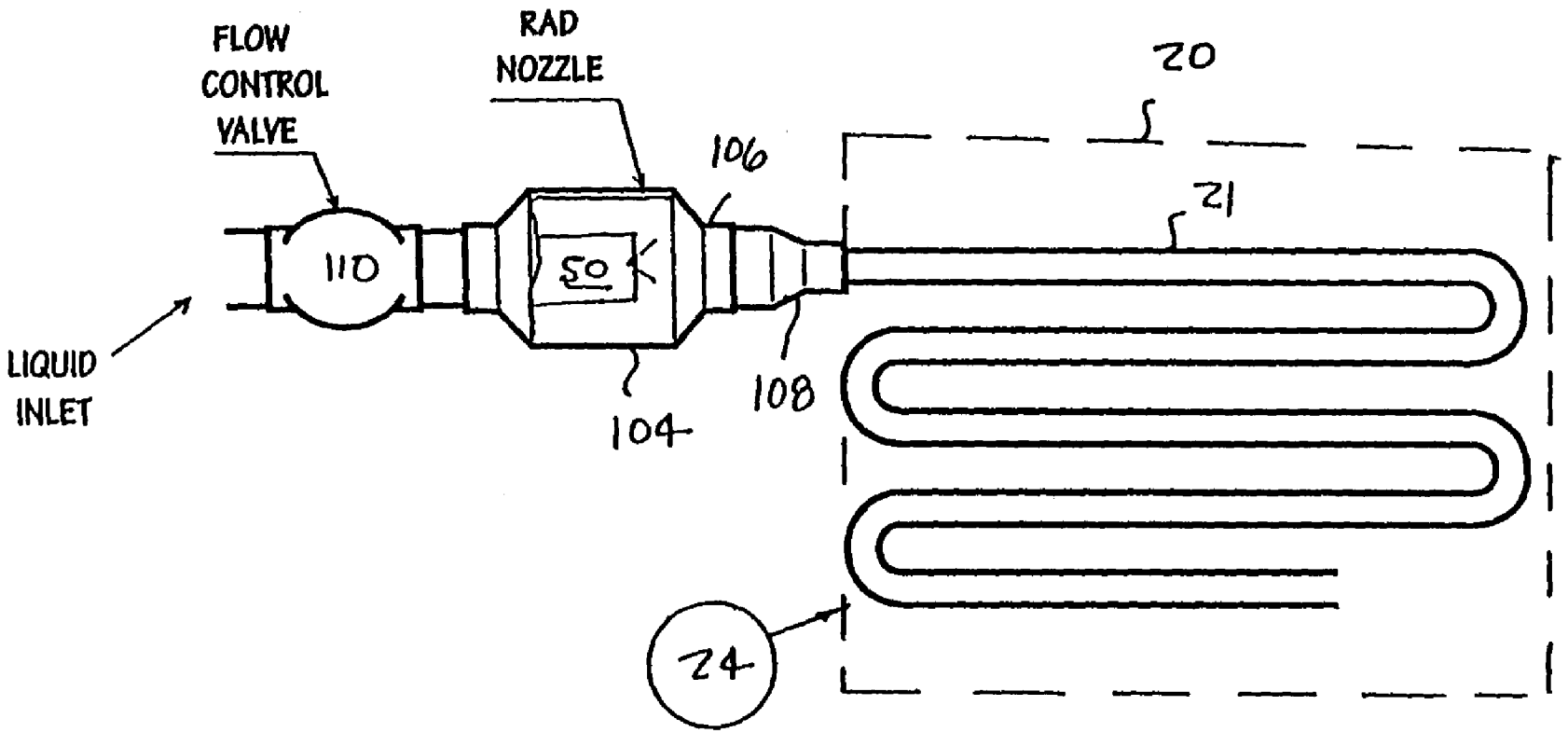
FIG. 3 is a diagram similar to FIG. 1 showing the device of the present invention in a circuit including a flow-control valve.

Turning now to FIG. 3, a single circuit evaporator 20 is shown similar to that depicted in FIG. 2. An atomization nozzle 50 is again shown contained within a housing 104 which discharges through reducer sections 106, 108 into the single circuit evaporator circuit 21. Interposed between the condenser 14 and the atomization nozzle is a flow-control valve 110 which may be adjusted to control the rate of flow through the atomization nozzle 50 into the evaporator. The flow-control valve may be used to regulate the flow within the refrigeration system in accordance with load requirements.

Figure 4:
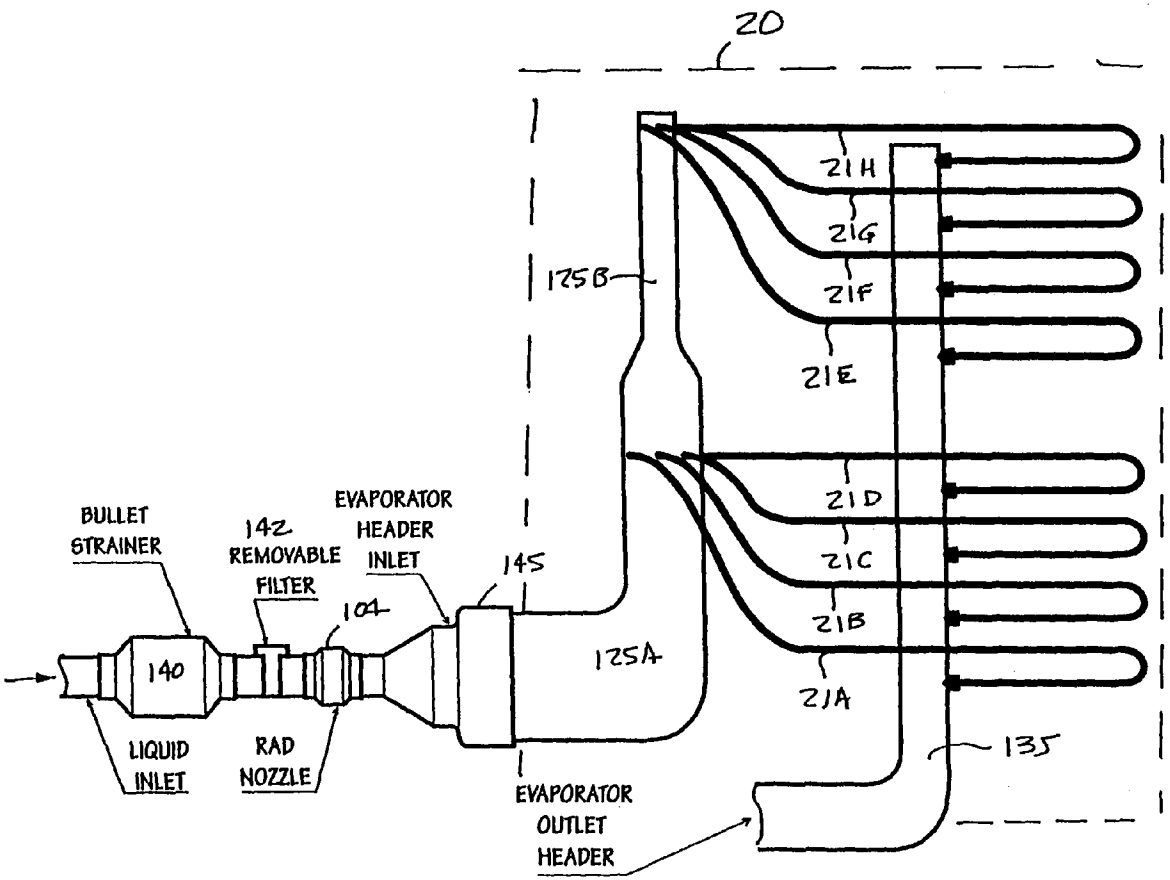
FIG. 4 is a schematic view showing the atomization device of the present invention installed in a refrigeration circuit discharging into an evaporator outlet header which is connected to a plurality of evaporator circuits.

Turning to FIG. 4, another embodiment of the present invention is shown in connection with an evaporator 20 having multiple circuits which are designated 21A to 21H. The evaporator 20 has a header 125 having a first section 125A of a greater diameter which converges at an intermediate section to a section 125B having a reduced diameter. Circuits 21E to 21H are connected to the reduced diametral section of the inlet header at one end and have their opposite end connected to an evaporator outlet header 135. Circuits 21A, 21B, 21C and 21D are connected at their inlet ends to the larger diameter section 125A of the inlet header and at their outlet ends are connected to the evaporator outlet header 135. Air to be cooled is forced through the evaporator by fan 24. However, in many evaporators, the airflow across the evaporator is non-uniform with some circuits, such as circuits 21E to 21H, experiencing less airflow than circuits 21A to 21D. As a result, if the refrigerant flow rate is uniform, circuits 21E to 21H are considered "rich" in refrigerant having a refrigerant flow rate in excess of that actually required to effectively cool the volume of airflow across these circuits. The inlet header section 125B restricts flow so evaporator circuits 21E to 21H receive less refrigerant and circuits 21A to 21D which experience higher airflow rates also receive higher refrigerant flows.

An atomization nozzle 50 is contained within housing 104 and is connected to a high pressure liquid inlet line 31 from the condenser 14. A liquid strainer 140 such as a "bullet" strainer may be interposed at a location ahead of the inlet to the atomization nozzle. Similarly, a removable filter 142 may also be installed to remove other materials. The nozzle 50 discharges into the evaporator header inlet 145 which is connected to the evaporator header section 125A.

Figure 5:
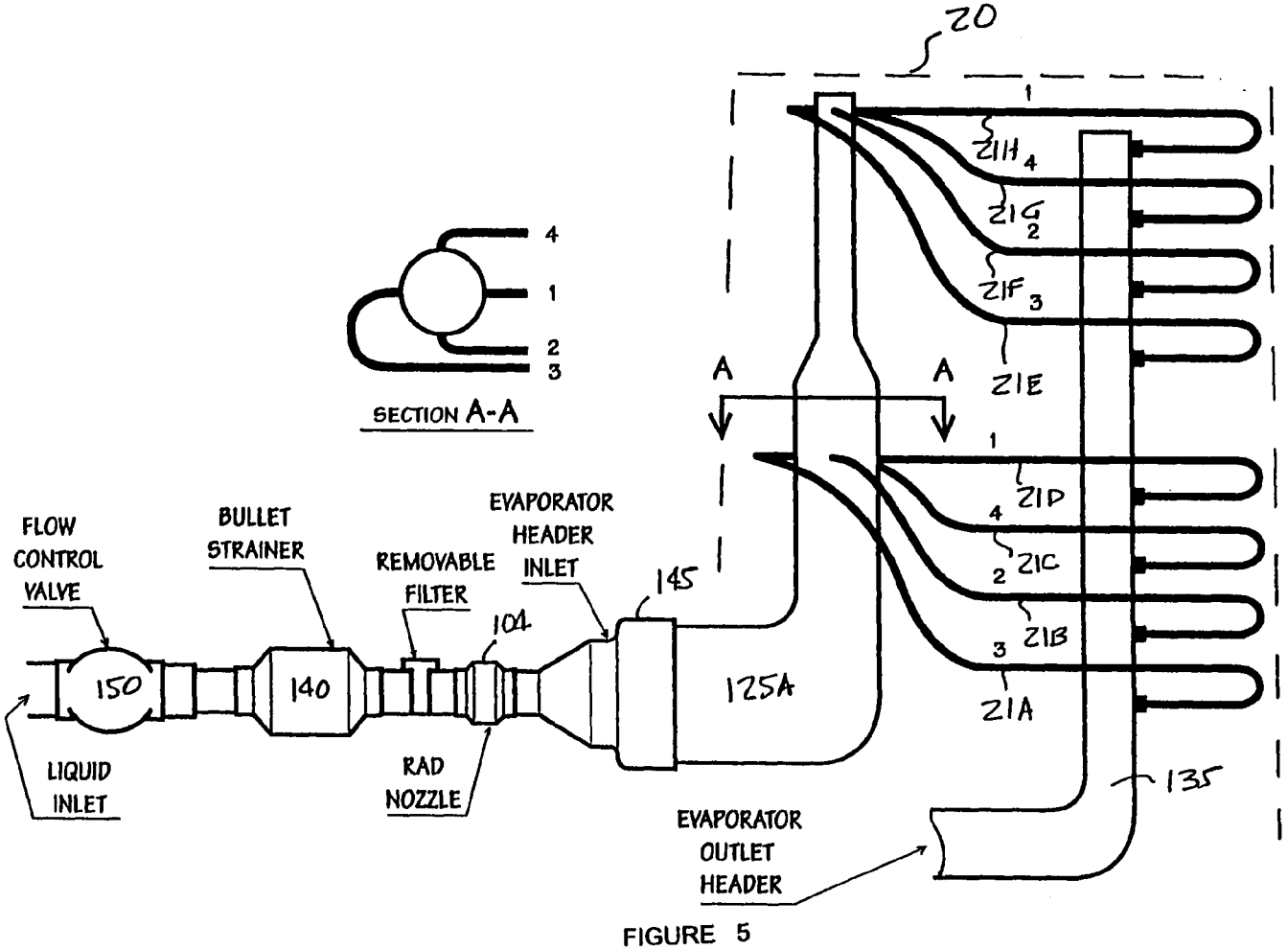
FIG. 5 is a schematic view similar to FIG. 4 showing the atomization device installed in a circuit along with a flow-control valve.

FIG. 5 shows an atomization system similar to that shown in the previous drawing FIG. 4 with the addition of a flow-control valve 150 interposed in the refrigerant line 30 upstream of the bullet strainer 140 and filter 142. The inlet header sections 125A, 125B connect to the individual evaporator circuits. The header diameter or size is reduced to distribute greater flow to the circuits 21A to 21D experiencing the greatest airflow to achieve improved efficiency. The determination of the airflow rates across the evaporator circuits will be described below.

Figure 6:
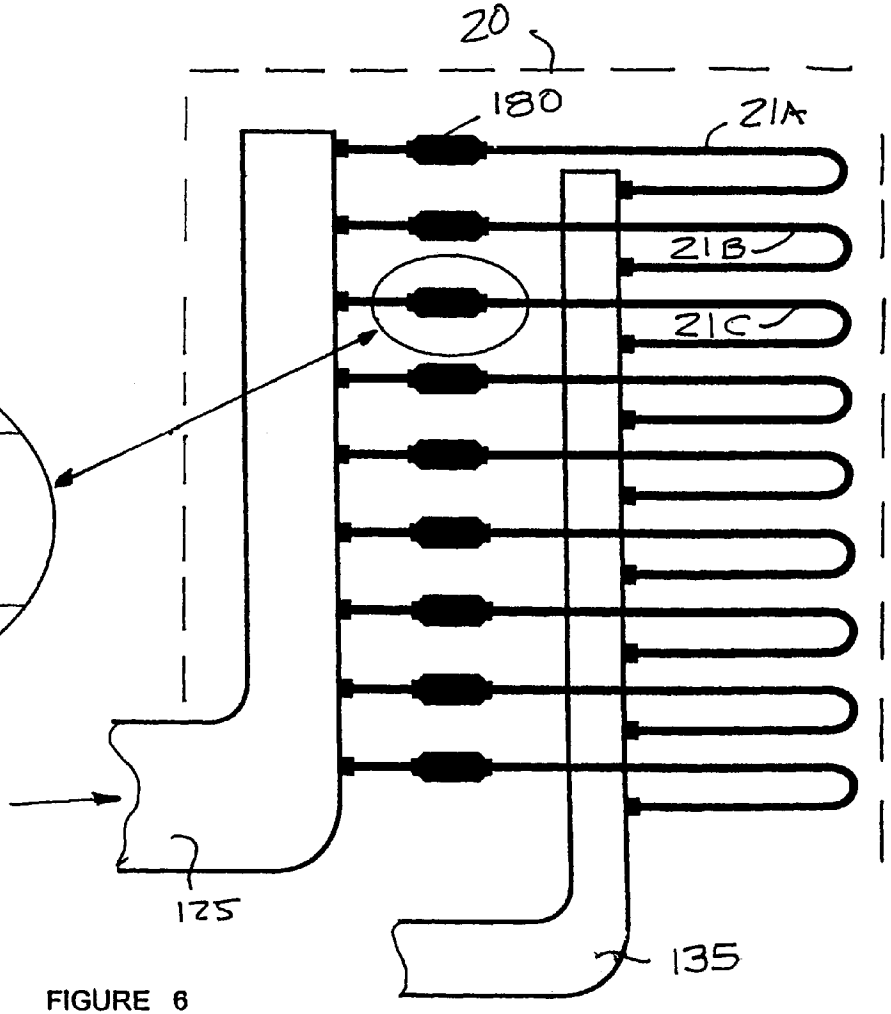
FIG. 6 is a schematic view showing another embodiment of the present invention in which an atomization device is installed in each of the multiple circuits between the inlet and outlet headers of a refrigeration evaporator.
Figure 6A:
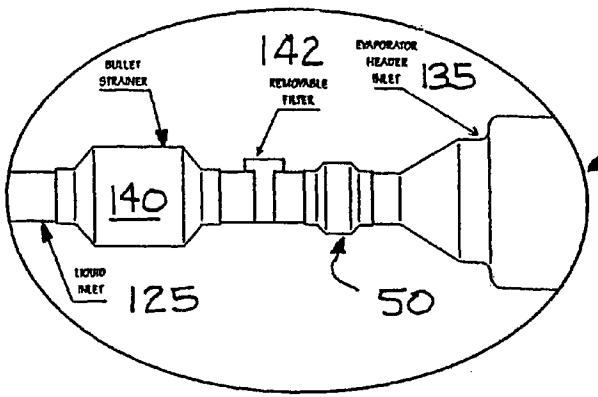
FIG. 6A is a detail view as indicated in FIG. 6.
Figure 7:
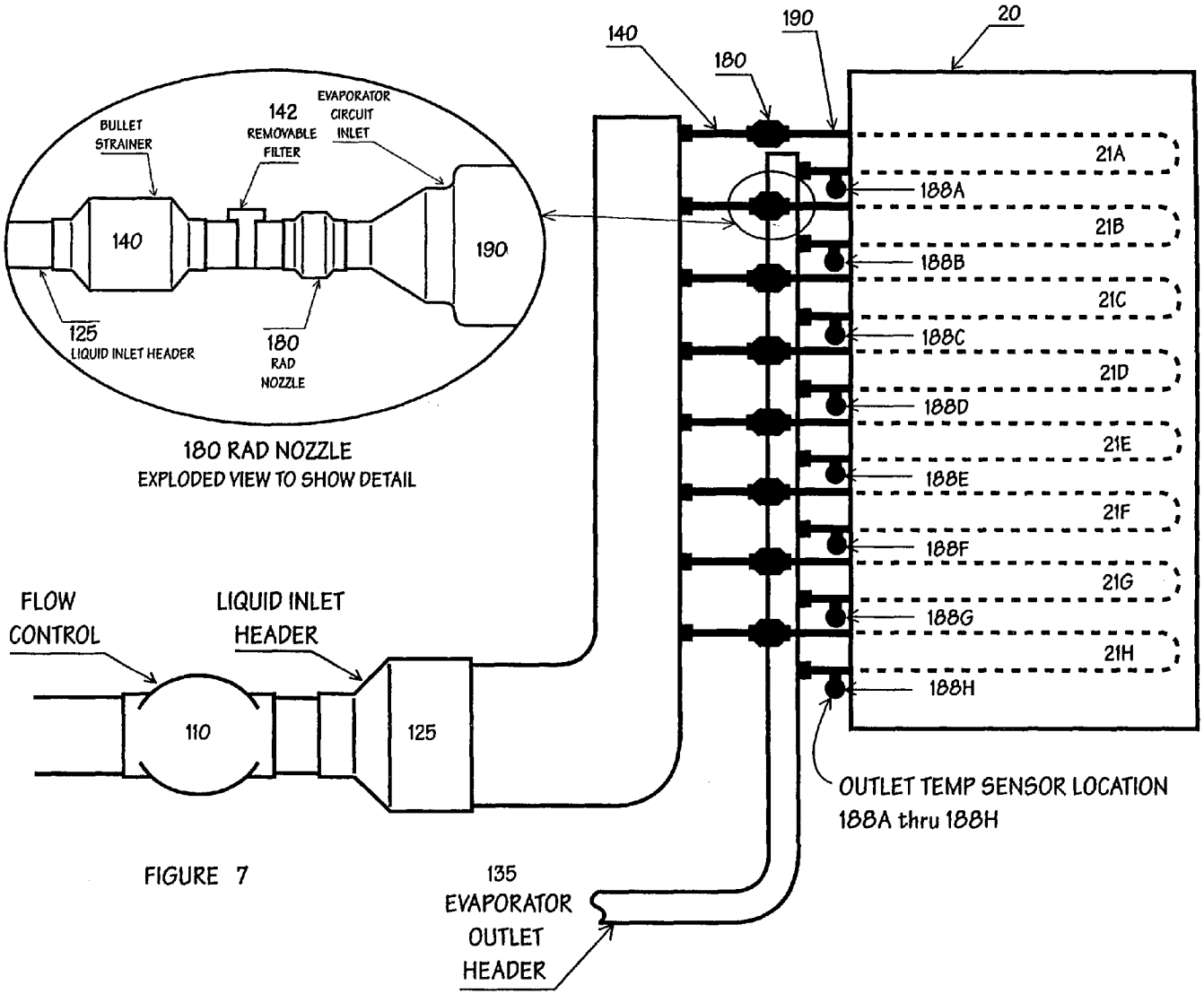
FIG. 7 is a view similar to FIG. 6 further showing the device of FIG. 6 in conjunction with a flow-control valve.

FIGS. 6, 6A and 7 show an evaporator 21 having an inlet header 125 which is directly connected to the output from the condenser. A plurality of evaporator circuits 21A to 21H each have their inlets connected to the liquid header 125 and have their outlets connected to an outlet header 135 in the evaporator. As is conventional, air is forced by a fan or blower 24 across the multiple circuits in the evaporator to effect heat exchange with the refrigerant to cool the air. In this system, each individual circuit includes a nozzle housing 180 containing one or more atomization nozzles 50 which discharge a fine atomized spray into the associated evaporator circuit. As shown in FIG. 6A, each individual circuit may also include a filter 142 and a strainer 140. The various nozzles 50 in each circuit may be sized to properly distribute the refrigerant flow "tuned" to the appropriate airflow rate in the associated circuit. If the airflow across the various evaporator circuits is essentially equal, the nozzles 50 in each circuit will be similarly sized. If airflow is unevenly distributed, the nozzles may be appropriately sized to provide a refrigerant flow consistent with airflow rates. The conditions in each circuit are measured by insertion of an appropriate probe or sensor such as an airflow or temperature sensor at or near the outlets of the evaporator circuits at locations 188A to 188H.

FIG. 7 shows a system similar to that shown in the previous drawing with the addition of a flow-control valve 110 interposed between the condenser and the liquid inlet header. The flow-control valve can either be a manual valve, an electrically or electronically operated valve or a thermostatic expansion valve that will adjust refrigerant flow in accordance with load conditions by sensing or measuring temperatures at the evaporator outlet or other system location. The other components are as described with reference to FIG. 6 with each evaporator circuit having one or more atomization nozzles in a housing 180 with the nozzle flow rates adjusted to the airflow rates.

Figure 8:
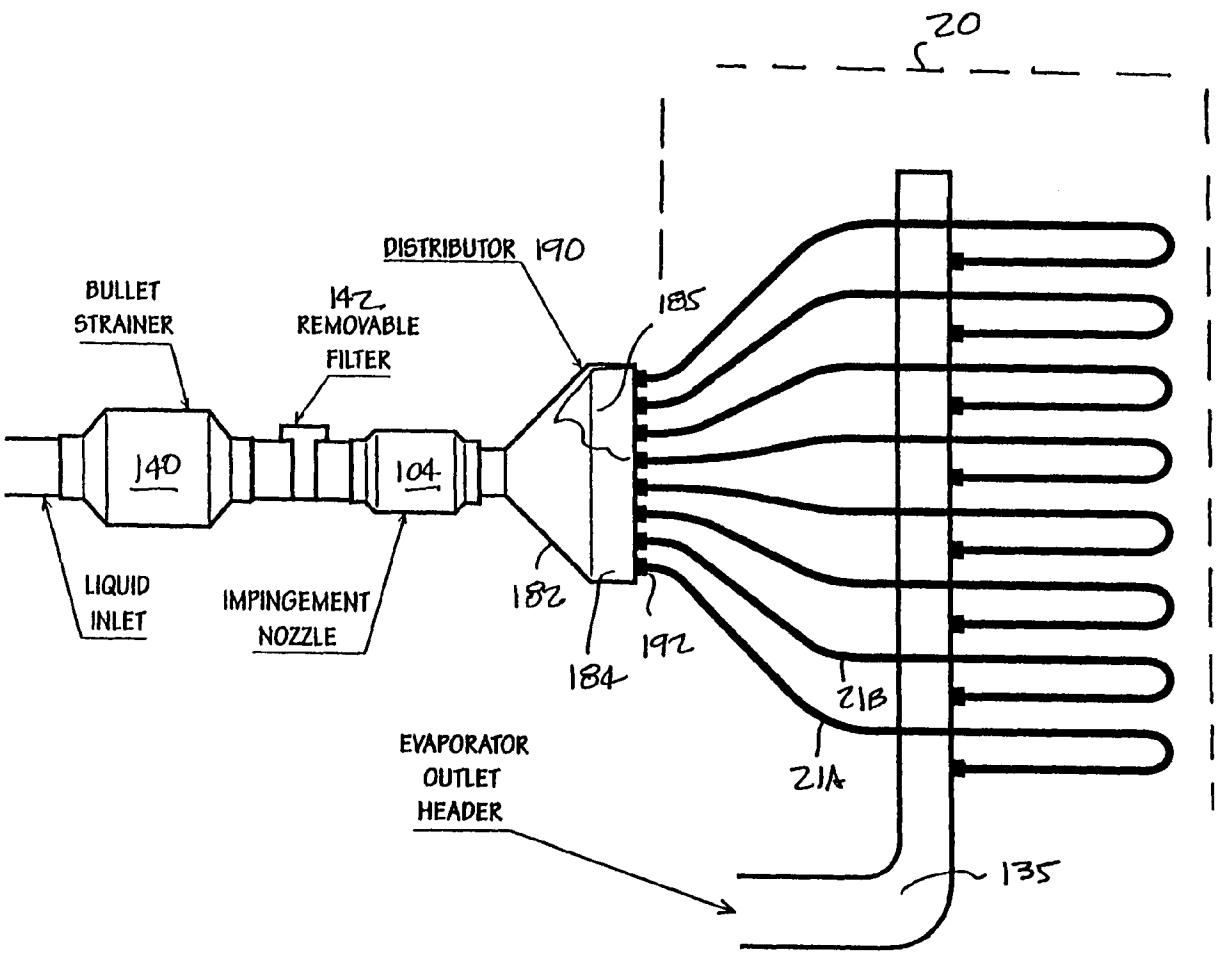
FIG. 8 is a schematic showing yet another embodiment of the present invention which the atomization device discharges into a distributor having multiple outlets each connected to the various circuits in the evaporator.

Another embodiment of the atomization system of the present invention is shown in FIG. 8. In this embodiment, the distributor 190 is connected to housing 104 which contains one or more atomization nozzles 50, as described above. A removable filter 142 and strainer 140 may be interposed ahead of the nozzle housing. The outlet of the nozzle housing 104 is connected to the inlet of distributor 190. The distributor 190 is shown as having a conical wall 182 and an end plate 184. The atomized refrigerant from the nozzle housing is discharged into the chamber 187 of the distributor housing. The distributor housing is provided with a plurality of fittings 192, each connected to a circuit in the evaporator. Each evaporator circuit 21A to 21H is connected to the evaporator outlet header 135. In this embodiment, the atomized, saturated liquid received in the distributor 190 is directed to the various multiple circuits for cooling air which is directed across the circuits in the evaporator. The flow rate of the nozzles may be the same or individually and selectively sized to accommodate airflow variations within the evaporator.

Figure 9:
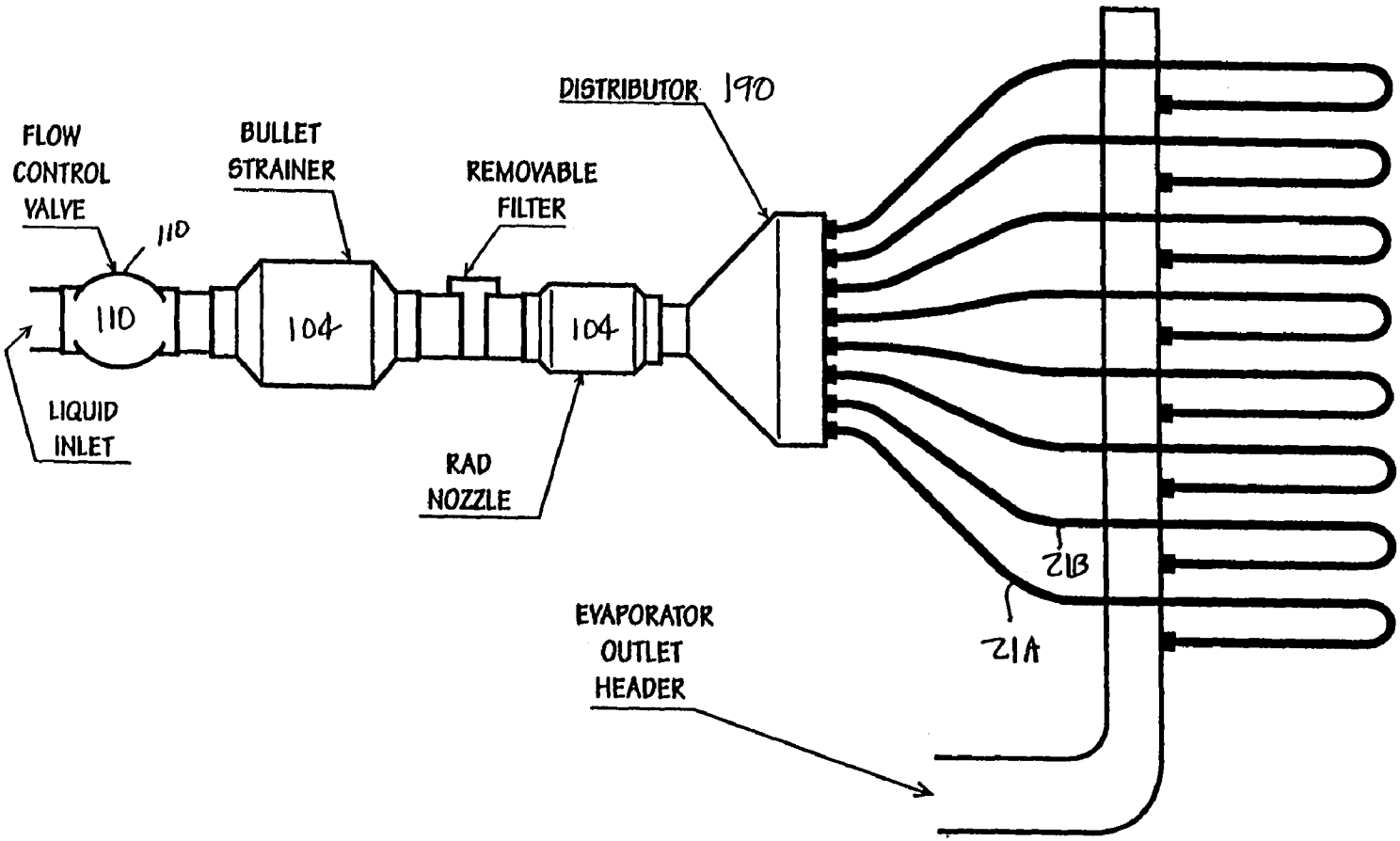
FIG. 9 is a schematic view similar to FIG. 8 further including a flow-control valve.

FIG. 9 shows an embodiment of the present invention similar to that shown in FIG. 8, with the addition of a flow-control valve 110 in the liquid inlet line ahead of the nozzle 50. Again, the distributor communicates with the discharge of the nozzle housing 140 and will direct atomized liquid to the various circuits in the evaporator.

Figure 10:
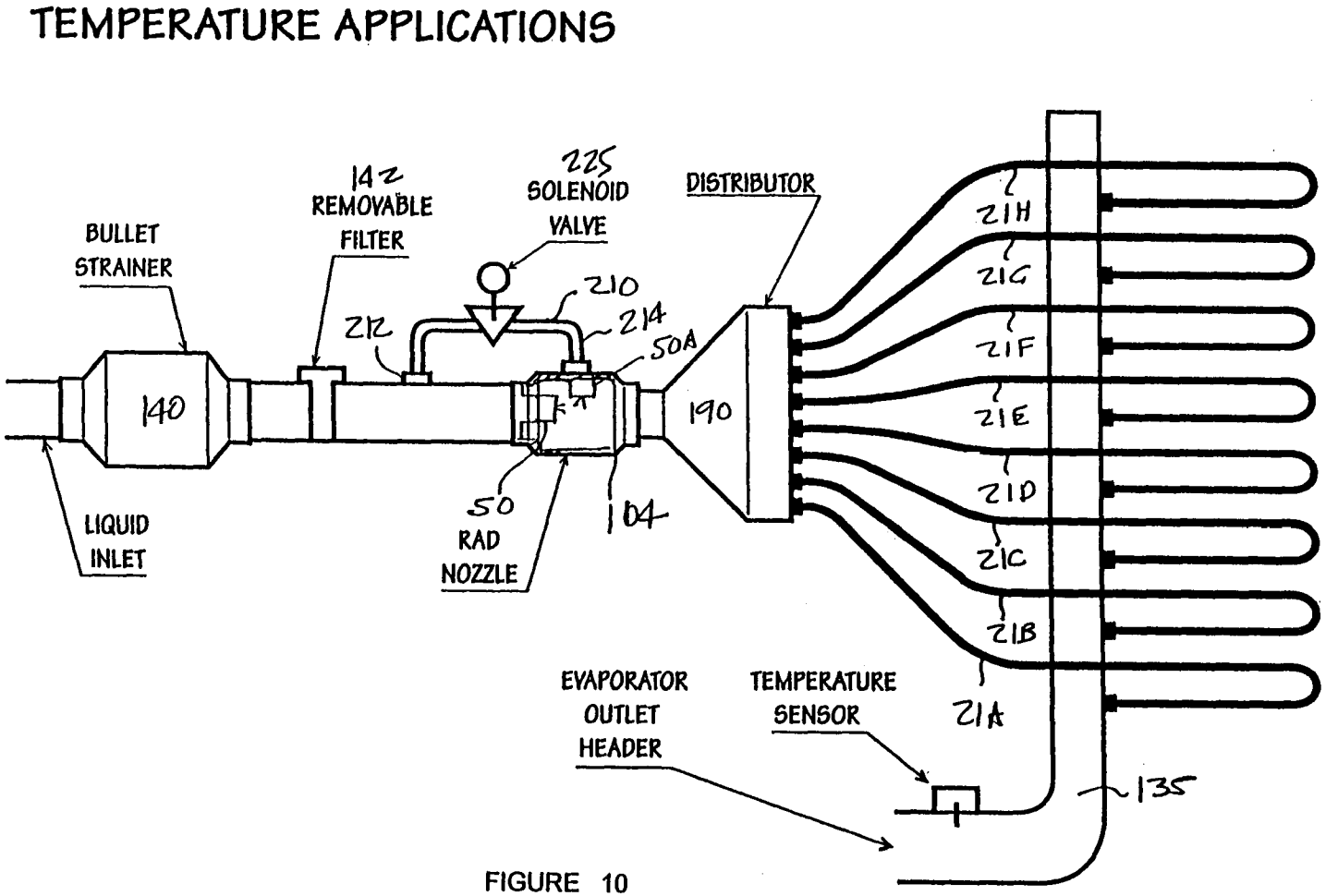
FIG. 10 is a schematic diagram showing the atomization device of the present invention discharging into a distributor having outlets connected to the various circuits of an evaporator and further including a bypass system for delivering additional refrigerant to meet increased load demands.

In some applications, increased load demand under certain operating conditions such as during startup or periods during which high temperatures are experienced. In such instances, additional refrigerant to meet the demand may be required. In FIG. 10, atomization nozzle 50 has its inlet connected to the liquid inlet line from the condenser and are contained in housing 104. As shown in previous embodiments, a strainer 140 and filter 142 may also be provided in the liquid line. The discharge from the atomization nozzles again connects to a distributor 190 which is shown as having a conical housing with fittings connected to the various circuits 21A to 21H of the evaporator. The evaporator circuits each discharge into an outlet header 135. To provide additional cooling capacity under periods of higher demand, a refrigerant bypass conduit 210 is provided having an inlet 212 ahead of the atomization housing 104 and a discharge 214 that extends into the housing. The discharge is shown as extending radially into the housing but may also be oriented in a horizontal direction. The addition of an auxiliary nozzle 50A provides additional refrigerant capacity. A solenoid valve 225 is interposed in the bypass line and will open under periods of higher demand and close during periods of normal demand. A temperature sensor 250 senses temperature in the evaporator outlet header and will open or close the solenoid valve as load demand requires as indicated by the temperature at a measuring point in the system.

Figure 12:
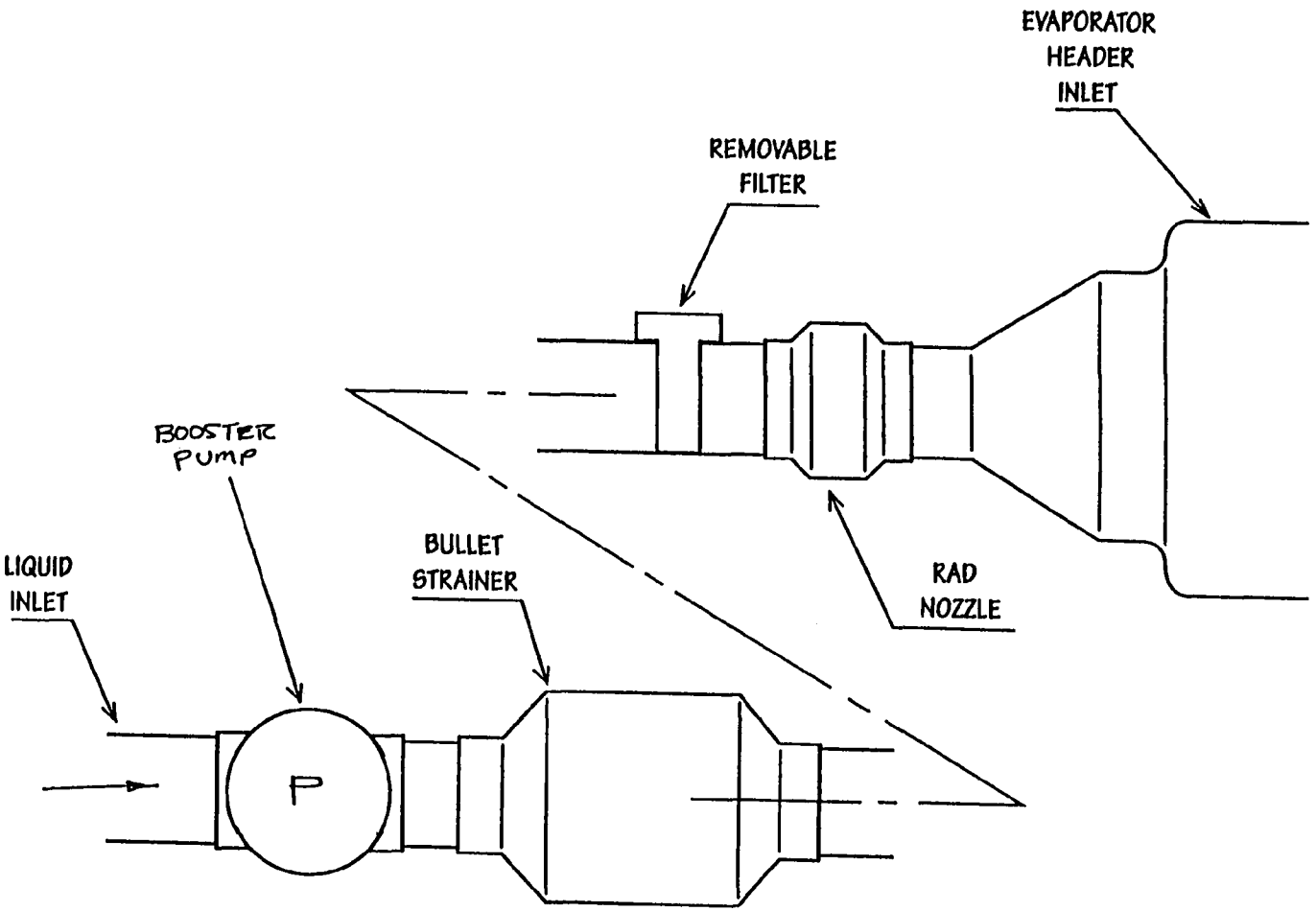
FIG. 12 is a schematic diagram showing the addition of a booster pump in the refrigerant circuit to increase the pressure of the refrigerant entering the atomization nozzle.

In FIG. 12, the liquid inlet 30 communicates with a booster pump 250 which increases the pressure of the refrigerant prior to passing through the trainer, filter and entering the nozzle housing 104. The refrigerant is atomized by nozzles 50 and the higher pressure may, in some installations, result in better atomization and dispersion of the fine droplets.

As mentioned above, it may be advantageous to size the atomization nozzles communicating with the various evaporator circuits so that the refrigerant flow rate is proportioned with the airflow rate across each circuit as the airflow rate may vary substantially. The use of atomizing nozzles, as described, may be applied to new refrigeration units or may be applied to existing units to improve efficiency. Atomization will emit a saturated liquid of fine droplets of about 10 micron size.

Generally, a flow rate of about 0.5 GPM of refrigerant is required for each ton of refrigeration. If the airflow across the circuits of an evaporator having multiple circuits is substantially equal, then the flow rate across each atomization nozzle is calculated by the following formula:

$$\text{FLOW RATE EACH NOZZLE} = \frac{(.5\ GPM)(\#\ \text{TONS})}{\#\ \text{CIRCUITS}}$$

If, however, the airflow rate varies substantially across the evaporator circuits, the individual nozzles may be sized to provide a refrigerant flow in each circuit consistent with the airflow across the circuit to provide optimum efficiency. If, for example, an evaporator circuit is "rich" in refrigerant based on airflow rate, optimum heat exchange does not occur as more fluid passes through the circuit than is necessary for cooling the air at the expense of "starving" other circuits which are experiencing greater airflow.

The initial step is to determine the airflow across each evaporator circuit which may be measured by airflow sensors. Another method is to monitor the temperature at the point in each evaporator circuit which is at or near the outlet header. Temperature probes can be installed and the unit operated for a period of time and the circuit temperatures recorded.

Thereafter, the unit is shut down and a quantity of refrigerant, e.g. one-half pound, is removed. The system is run for a period of time and the discharge temperature noted. The procedure is repeated and discharge temperature readings will indicate the load on each of the circuits. The circuits on which the greatest loads are imposed will show the initial temperature increase, as the quantity of refrigerant is reduced. Those circuits "rich" in refrigerant will be the last to show a discharge temperature increase. The procedure is continued until all circuits indicate the same or about the same elevated temperature increase. The order of the temperature increase will indicate the sizing order for the nozzles from largest to smallest. Some trial and error may be necessary.

EXAMPLE

A system was tested by installing atomization nozzles manufactured by BEX in an existing 3 ton refrigerator unit manufactured by Goodman. The existing capillary tubes were removed and replaced by nozzles in each of the eight evaporization circuits. Three tons of refrigeration requires a total flow rate of about 1.5 GPM of R22 refrigerant. If all circuits are operating under the same load conditions, the flow rate for each circuit would be 0.1875 GPM.

However, in testing the effective loads on each circuit by the temperature method described above, it was determined that four circuits were carrying approximately 29% of the cooling load, the next two about 24% of the load, and the next two about 42% of the load due to the evaporation configuration and airflow considerations.

Atomization nozzles were installed to provide 0.115 GPM on circuits 1 to 4; 0.188 GPM on circuits 5 and 6 and 0.367 GPM on circuits 7 and 8 totaling 1.568 GPM. The manufacturer rated the unit at approximately 36,000 BTU's. testing indicated an increase to approximately 49,000 BTU's or about a 38% increase with no increase in energy input.

It will be obvious to those skilled in the art to make various changes, alterations and modifications to the invention described herein. To the extent such changes, alterations and modifications do not depart from the spirit and scope of the appended claims, they are intended to be encompassed therein.

I claim:

1. A compression refrigeration system having a compressor, condenser and an evaporator having multiple circuits and airflow means delivering airflow at varying rates to said multiple circuits, said system comprising:

(a) an inlet housing communicating with said condenser for receiving high pressure liquid directly from the condenser;

(b) each of said multiple evaporator circuits having an inlet and an outlet; and (c) a spray nozzle located at the inlet to selected of said multiple evaporator circuits, said nozzles each having an inlet receiving high pressure refrigerant from said inlet housing and atomizing and expanding the refrigerant and discharging the atomized and expanded saturated liquid at the nozzle outlet into said associated evaporator circuit, said nozzles each being sized to deliver refrigerant in accordance with the conditions at the outlet of the associated evaporator circuit measured by a sensor to deliver a greater volume of refrigerant to those evaporator circuits experiencing higher airflow and a lesser volume of refrigerant to those evaporator circuits experiencing lower airflow wherein expansion of the refrigerant delivered to the evaporator circuits occurs exclusively across said nozzles eliminating any requirement for any other type of expansion device in the system.

2. The atomization and expansion device of claim 1 further including filtering means interposed between the inlet housing of the condenser.

3. The atomization and expansion device of claim 1 wherein said inlet housing has sections of varying cross-sectional areas to refrigerant to distribute the refrigerant to the circuits based on load.

4. The atomization and expansion device of claim 1 further including pressure boosting means receiving refrigerant from said condenser and discharging into said inlet housing.

5. The atomization and expansion device of claim 1 wherein said spray nozzle discharges into a distributor, said distributor having a plurality of outlets each of which is connected to an evaporator circuit.

6. The atomization and expansion device of claim 1 further including a by-pass communicating with an auxiliary spray nozzle and a control valve for selectively delivering fluid to said auxiliary spray nozzle.

7. The compression refrigeration system of claim 1 including a flow control valve interposed between the condenser and inlet housing.

8. In a compression refrigeration system comprising a compressor and a condenser, the improvement consisting of:

(a) an evaporator having:

(i) an inlet housing communicating with said condenser for receiving high pressure liquid directly from the condenser;

(ii) multiple evaporator circuits communicating with said inlet housing, each evaporator circuit having an inlet and an outlet, said evaporator outlets communicating with said compressor;

(iii) airflow means for delivering air to said evaporator circuits; and (b) expansion and atomizing means consisting of spray nozzles wherein a nozzle is located in the inlet to each of said multiple evaporator circuits, said nozzles each having an inlet and an outlet, said nozzle inlets receiving high pressure refrigerant from said inlet housing and atomizing and expanding the refrigerant and discharging the atomized and expanded saturated liquid at the nozzle outlet into the said associated evaporator circuit, said nozzles each being sized to deliver refrigerant in accordance with measured conditions at the outlet of the associated evaporator circuit to deliver a greater volume of refrigerant to those circuits experiencing higher airflow and a lesser volume of refrigerant to those evaporator circuits experiencing lower airflow.

* * * * *